US010851577B2

(12) United States Patent
Gokan et al.

(10) Patent No.: US 10,851,577 B2
(45) Date of Patent: Dec. 1, 2020

(54) OPENING AND CLOSING APPARATUS FOR VEHICLES

(71) Applicant: MITSUBA Corporation, Gunma (JP)

(72) Inventors: Ryo Gokan, Gunma (JP); Yoshitaka Urano, Gunma (JP)

(73) Assignee: MITSUBA Corporation, Gunma (JP)

( * ) Notice: Subject to any disclaimer, the term of this patent is extended or adjusted under 35 U.S.C. 154(b) by 185 days.

(21) Appl. No.: 15/993,596

(22) Filed: May 31, 2018

(65) Prior Publication Data

US 2018/0347253 A1 Dec. 6, 2018

(30) Foreign Application Priority Data

Jun. 2, 2017 (JP) ..... 2017-109629

(51) Int. Cl.
*E05F 15/643* (2015.01)
*E05F 15/655* (2015.01)
*E05F 7/04* (2006.01)

(52) U.S. Cl.
CPC ..... *E05F 15/643* (2015.01); *E05F 15/655* (2015.01); *E05F 7/04* (2013.01); *E05Y 2201/654* (2013.01); *E05Y 2201/66* (2013.01); *E05Y 2900/531* (2013.01)

(58) Field of Classification Search
CPC . E05F 15/643; E05F 15/655; E05Y 2201/654
USPC ..... 49/360, 361
See application file for complete search history.

(56) References Cited

U.S. PATENT DOCUMENTS 5,746,025 A * 5/1998 Shimura ..... B60J 5/06 49/360
6,134,836 A * 10/2000 Kawanobe ..... E05F 15/646 340/12.22
6,539,670 B2 * 4/2003 Haag ..... E05F 15/646 49/141
6,793,259 B2 * 9/2004 Sano ..... B60J 5/06 296/155
7,325,361 B2 * 2/2008 Rogers, Jr. ..... E05F 15/643 296/155

(Continued)

FOREIGN PATENT DOCUMENTS

CN 104228708 12/2014
CN 104736786 6/2015

(Continued)

OTHER PUBLICATIONS

"Office Action of China Counterpart Application," with English translation thereof, dated Nov. 13, 2019, p. 1-p. 15.

(Continued)

*Primary Examiner* — Marcus Menezes
(74) *Attorney, Agent, or Firm* — JCIPRNET

(57) ABSTRACT

Provided is an opening/closing apparatus for vehicles which reduces the size and weight by reducing the number of components and suppresses rattling of an opening/closing body through sliding resistance of cables. A guide plate is provided between a drum and a pulley to direct orientation of a closing-side cable and an opening-side cable drawn out from the drum to the pulley. The guide plate has a sliding contact curved surface with which the cables and are brought into sliding contact, and the guide plate is provided on a swing arm of a pulley case in which the pulley is rotatably housed.

2 Claims, 8 Drawing Sheets

(56) References Cited

U.S. PATENT DOCUMENTS

| | | | | |
|---|---|---|---|---|
| 10,023,031 | B2 * | 7/2018 | Atomura | E05F 15/646 |
| 10,443,288 | B2 * | 10/2019 | Okada | B60J 5/06 |
| 2004/0216383 | A1 * | 11/2004 | Rogers, Jr. | E05B 85/26 49/360 |
| 2010/0180508 | A1 * | 7/2010 | Yamaguchi | B60J 5/06 49/358 |
| 2013/0160581 | A1 * | 6/2013 | Okada | H02K 7/1004 74/89.2 |
| 2016/0060942 | A1 * | 3/2016 | Hansen | E05F 15/643 49/349 |
| 2016/0251888 | A1 * | 9/2016 | Makino | E05B 81/20 49/280 |
| 2016/0298372 | A1 * | 10/2016 | Seto | E05F 15/643 |
| 2018/0345766 | A1 * | 12/2018 | Urano | B60J 5/06 |
| 2019/0093412 | A1 * | 3/2019 | Urano | E05F 15/657 |

FOREIGN PATENT DOCUMENTS

| | | |
|---|---|---|
| CN | 106114161 | 11/2016 |
| EP | 0744310 | 11/1996 |
| JP | 2001115736 | 4/2001 |
| JP | 2014181536 | 9/2014 |
| JP | 2014181547 | 9/2014 |
| JP | 2015140525 | 8/2015 |
| WO | 2016125590 | 8/2016 |

OTHER PUBLICATIONS

"Office Action of China Counterpart Application", dated Jun. 2, 2020, with English translation thereof, p. 1-p. 12.

* cited by examiner

OPENING AND CLOSING APPARATUS FOR VEHICLES

CROSS-REFERENCE TO RELATED APPLICATION

This application claims the priority benefit of Japan application serial no. 2017-109629, filed on Jun. 2, 2017. The entirety of the above-mentioned patent application is hereby incorporated by reference herein and made a part of this specification.

BACKGROUND

Technical Field

The disclosure relates to an opening/closing apparatus for vehicles for opening/closing an opening/closing body.

Description of Related Art

A vehicle such as a minivan generally has a relatively large opening on a side portion. This opening may be exposed or closed by a sliding door (i.e., an opening/closing body) which moves in a front-rear direction of the vehicle. For example, Japanese Laid-open No. 2014-181536 describes an opening/closing apparatus for vehicles in which a sliding door is automatically opened and closed by driving of a driving device.

In the opening/closing apparatus for vehicles described in Japanese Laid-open No. 2014-181536, a driving part (a driving device) is mounted inside the sliding door. A closing-side cable and an opening-side cable go in and out of the driving part. An end of the closing-side cable is attached to a front end of a cable guide and an end of the opening-side cable is attached to a rear end of the cable guide.

The closing-side cable and the opening-side cable are respectively drawn out from inside the sliding door to the side of the vehicle body through a guide pulley (pulley) of a pulley part. The closing-side cable is routed toward the front of the vehicle body and the opening-side cable is routed toward the rear of the vehicle body. The guide pulley is provided with cable grooves around which the closing-side cable and the opening-side cable are wound respectively. The cable grooves are arranged to be side by side in an axial direction of the guide pulley.

Also, in the pulley part, a door-side pulley around which the closing-side cable is wound and a door-side pulley around which the opening-side cable is wound are provided around the same support shaft. The door-side pulleys are provided between the driving part and the guide pulley and direct orientations of the closing-side cable and the opening-side cable drawn from the driving part to the guide pulley, respectively.

Thus, in the opening/closing apparatus for vehicles described in Japanese Laid-open No. 2014-181536, a total of three pulleys (one guide pulley and two door-side pulleys) are provided.

Since the opening/closing apparatus for vehicles as described in the aforementioned Japanese Laid-open No. 2014-181536 has a total of three pulleys, sliding resistance of the cables can be reduced, which eases opening and closing of a relatively large sliding door such as one in a minivan. In other words, by providing a plurality of pulleys to reduce the sliding resistance of the pair of cables, it is possible to open and close a large sliding door while adopting a small low-power driving device.

In addition, sliding doors smaller and lighter than those of the minivans and the like are adopted in lightweight vehicles and the like. Therefore, in a small sliding door adopted for lightweight vehicles and the like, it would be excessive to provide a plurality of pulleys to reduce the sliding resistance of the cables. Moreover, the number of components would increase, which leads to an increase in size and an increase in cost. That is, it is expected to adopt a compact, lightweight and less costly opening/closing apparatus for lightweight vehicles and the like.

SUMMARY

According to an embodiment of the disclosure, an opening/closing apparatus for vehicles is provided for opening/closing an opening/closing body. The opening/closing apparatus includes: a guide rail movably supporting the opening/closing body; a driving device provided in the opening/closing body; a drum provided in the driving device, wherein cables for moving the opening/closing body are wound around the drum; a pulley provided in a vicinity of the guide rail and directing orientation of the cables in an extension direction of the guide rail; and a guide part provided between the drum and the pulley and directing the orientation of the cables drawn out from the drum to the pulley, wherein the guide part has a sliding contact curved surface with which the cables are brought into sliding contact, and the guide part is provided in a pulley case in which the pulley is rotatably housed.

According to another embodiment of the disclosure, the pulley case is made of resin, and the guide part is made of metal.

According to another embodiment of the disclosure, a seal cover for closing an opening of the pulley case is provided, and the seal cover includes a seal part that allows sliding of the cables and provides seal between inside and outside of the pulley case.

According to another embodiment of the disclosure, a cable guide for holding the cables is provided parallel to the guide rail, and a pair of inclined surfaces that is tapered toward the cable guide is provided in a portion of the seal cover that faces the cable guide.

DESCRIPTION OF THE EMBODIMENTS

Also, since the small sliding door is lightweight, the larger the sliding resistance of the cables is, the more desirable the function is. Specifically, for example, when a lightweight sliding door is stopped, it tends to rattle more than a heavyweight large sliding door. Therefore, the larger the sliding resistance of the cables is, the more the rattling of the lightweight sliding door is suppressed. In other words, the large "sliding resistance" of the cables can serve as a "cushioning function" to suppress the rattling of a lightweight sliding door.

The embodiments of the disclosure provide an opening/closing apparatus for vehicles which reduces the number of components, reduces the size and weight, and suppresses the rattling of the opening/closing body through the sliding resistance of cables.

According to one or some exemplary embodiments of the disclosure, the guide part is provided between the drum and the pulley to direct the orientation of the cables drawn out from the drum to the pulley. The guide part has the sliding contact curved surface with which the cables are brought into sliding contact, and the guide part is provided in the pulley case in which the pulley is rotatably housed.

Thus, it is possible to replace the previously required three pulleys with "one" pulley which directs the orientation of the cables in the extension direction of the guide rail. Therefore, the number of components can be reduced to reduce the size and weight.

In addition, since the cables are brought into sliding contact with the sliding contact curved surface of the guide part, the sliding resistance of the cables can be increased as compared with the related art. Therefore, with the increase in the sliding resistance, it is possible to effectively suppress the rattling of the small and lightweight opening/closing body.

Hereinafter, an embodiment of the disclosure will be described in detail with reference to the drawings.

Figure 1:
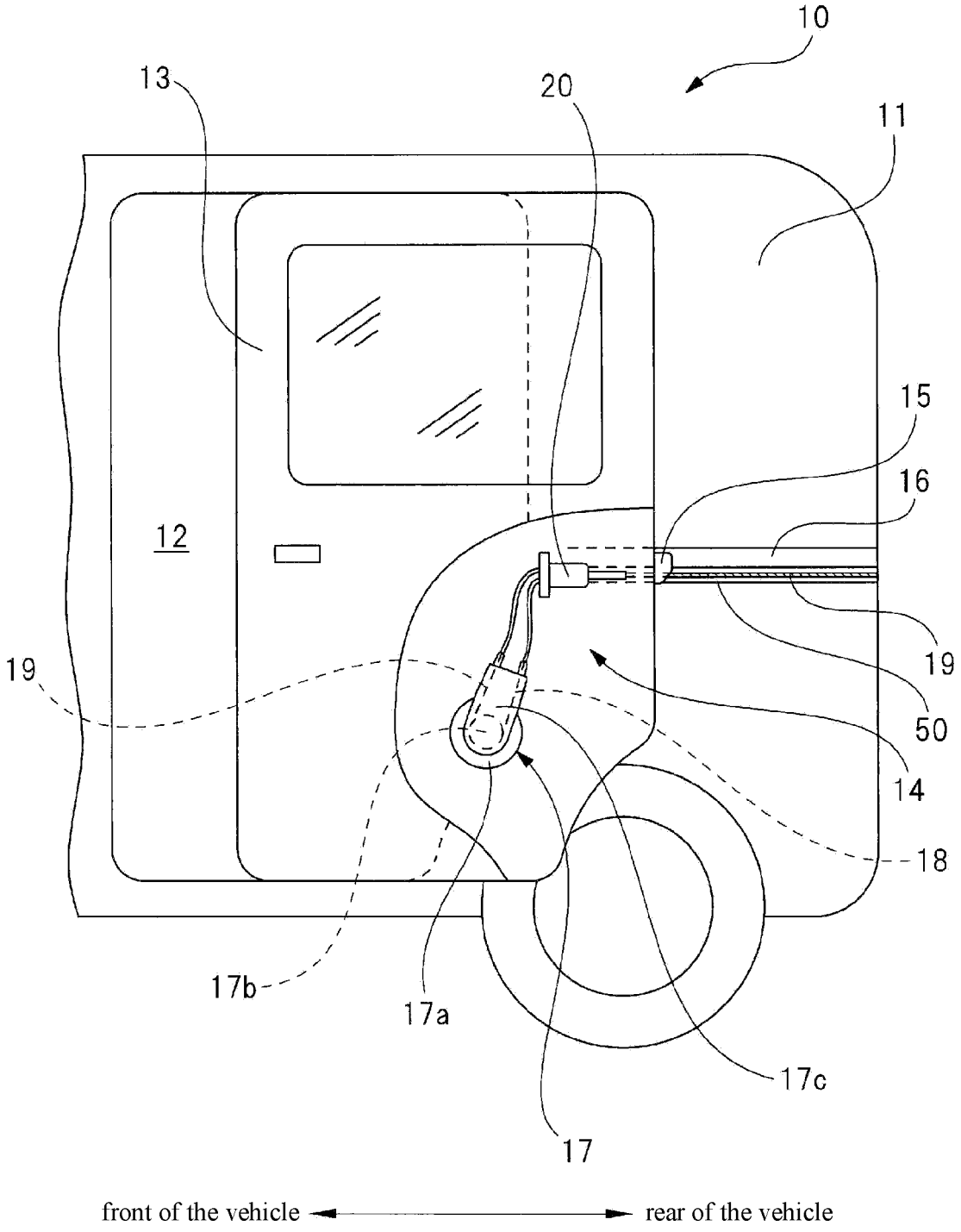
FIG. 1 is a schematic side view of a vehicle equipped with an opening/closing apparatus for vehicles according to an embodiment of the disclosure.
Figure 2:
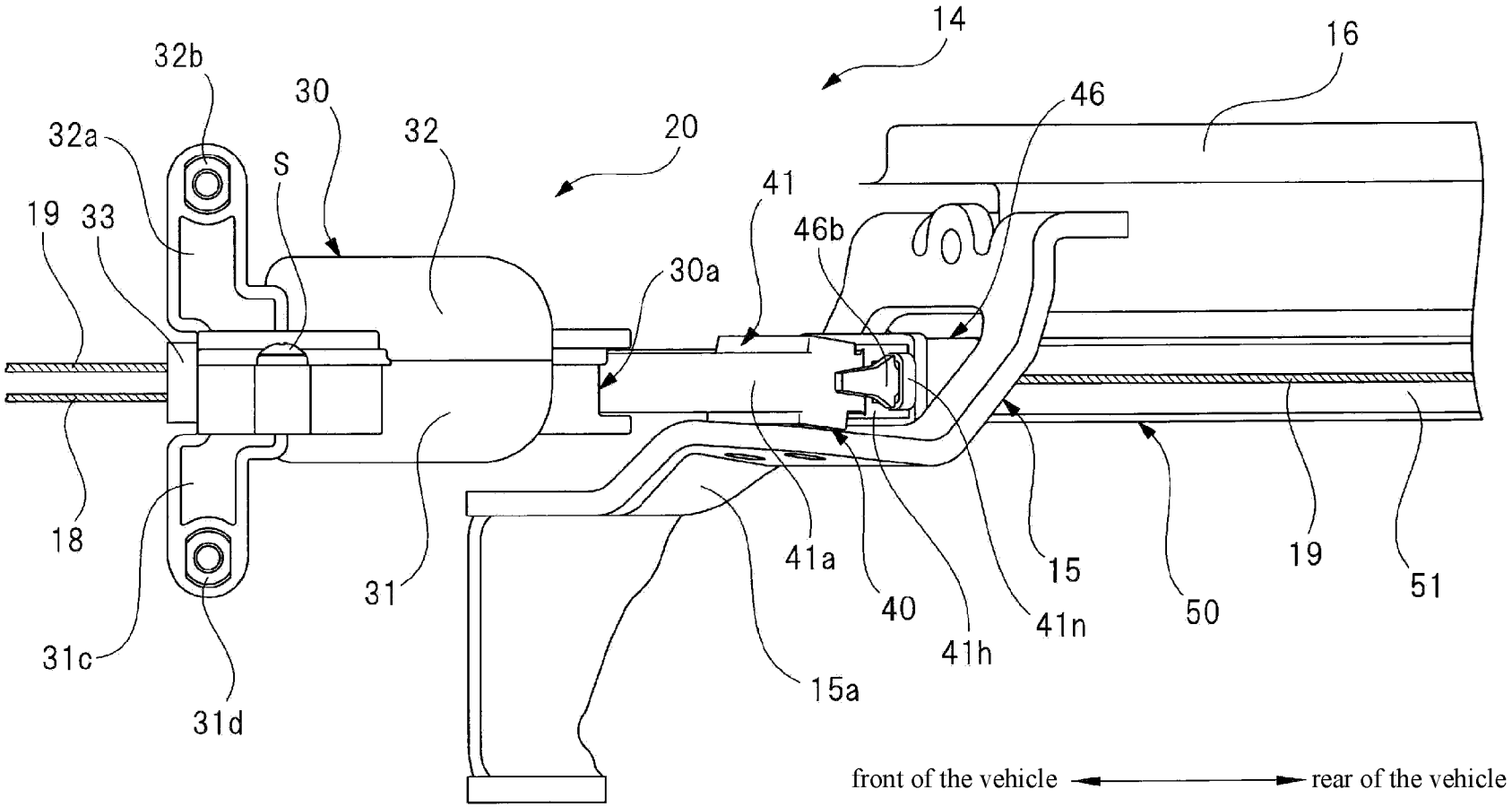
FIG. 2 is a schematic side view illustrating details of a pulley part of FIG. 1.
Figure 3:
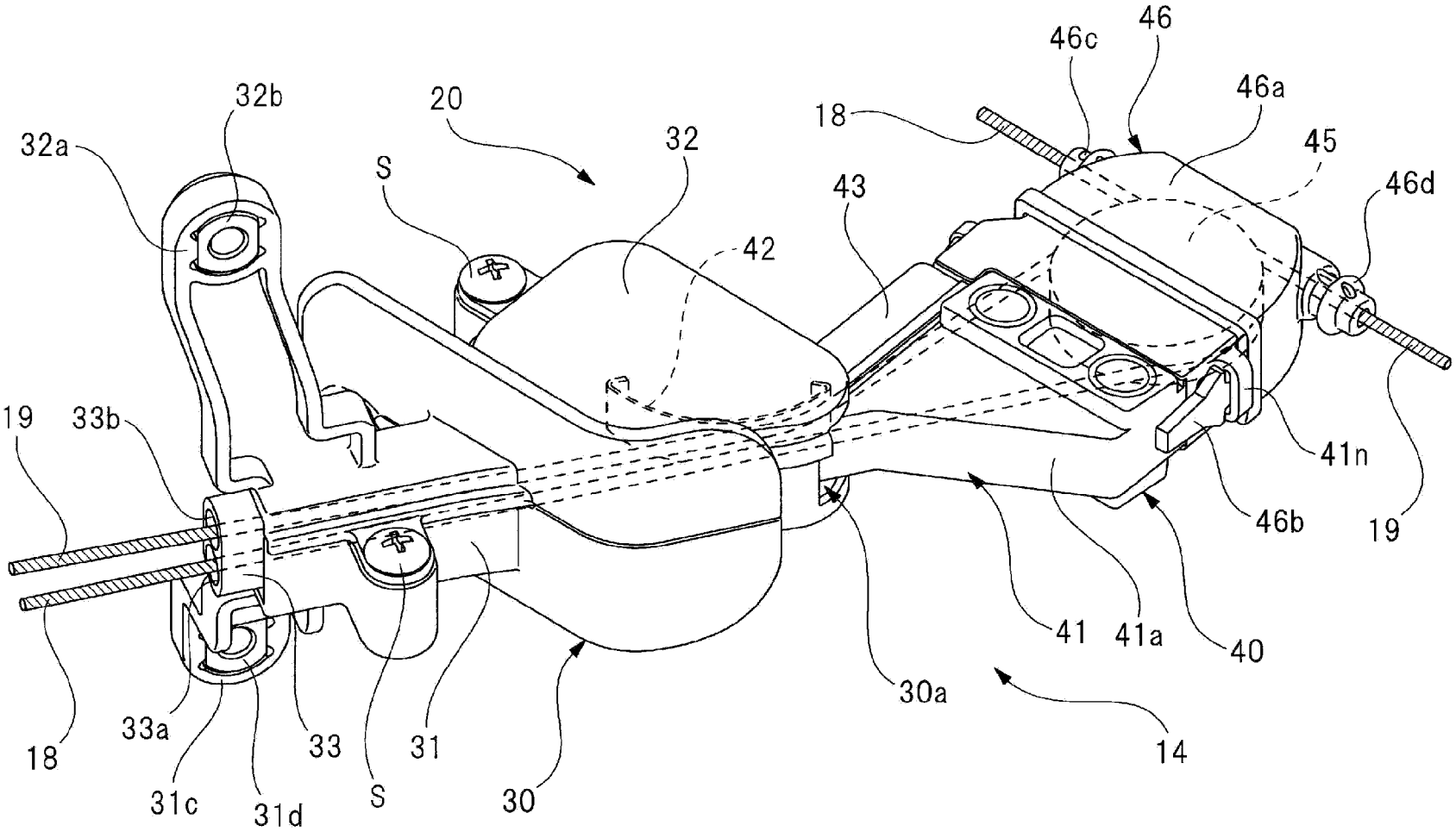
FIG. 3 is a schematic perspective view of the pulley part as viewed obliquely from above.
Figure 4:
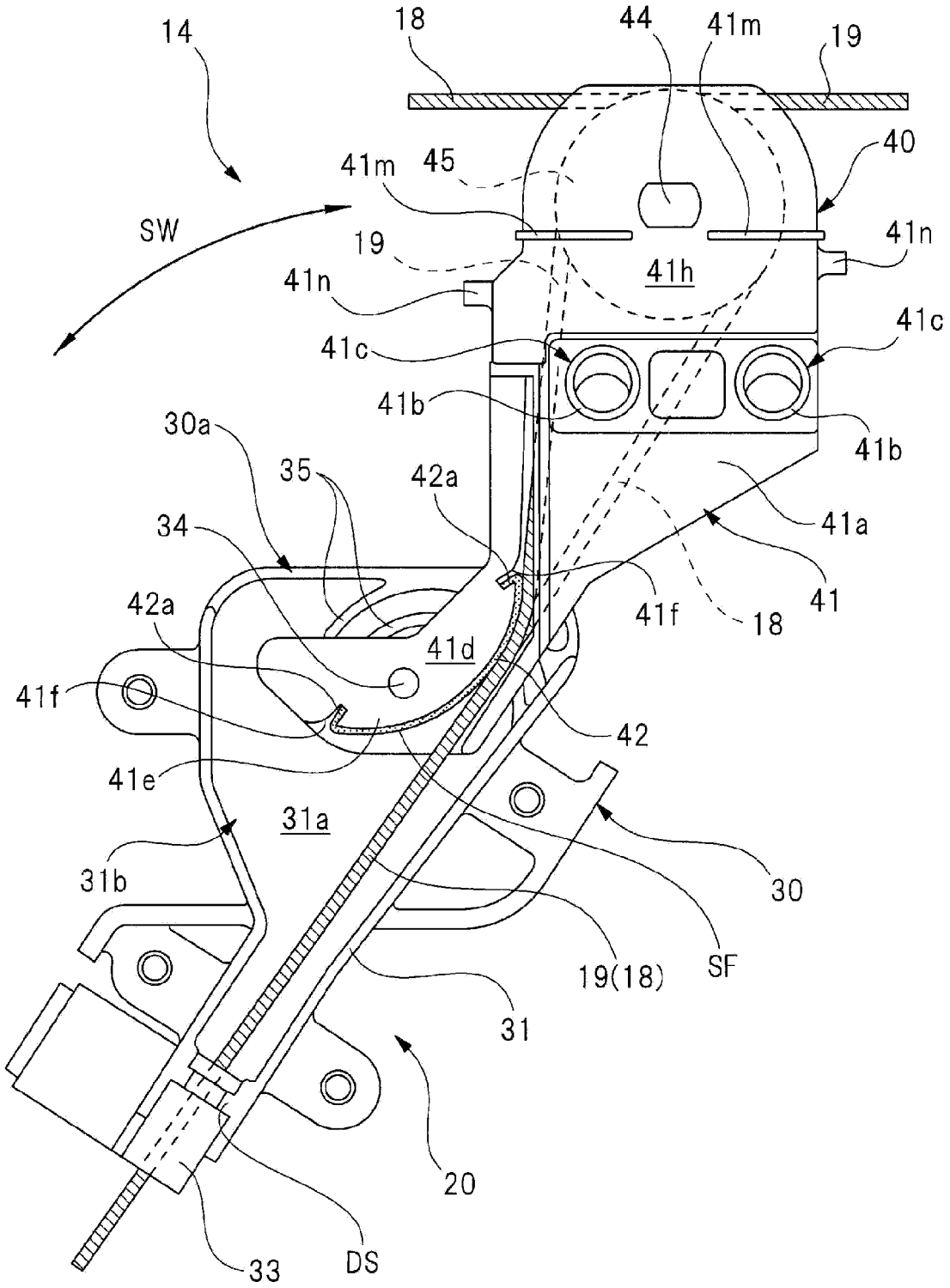
FIG. 4 is an explanatory diagram illustrating an internal structure of the pulley part.
Figure 5A:
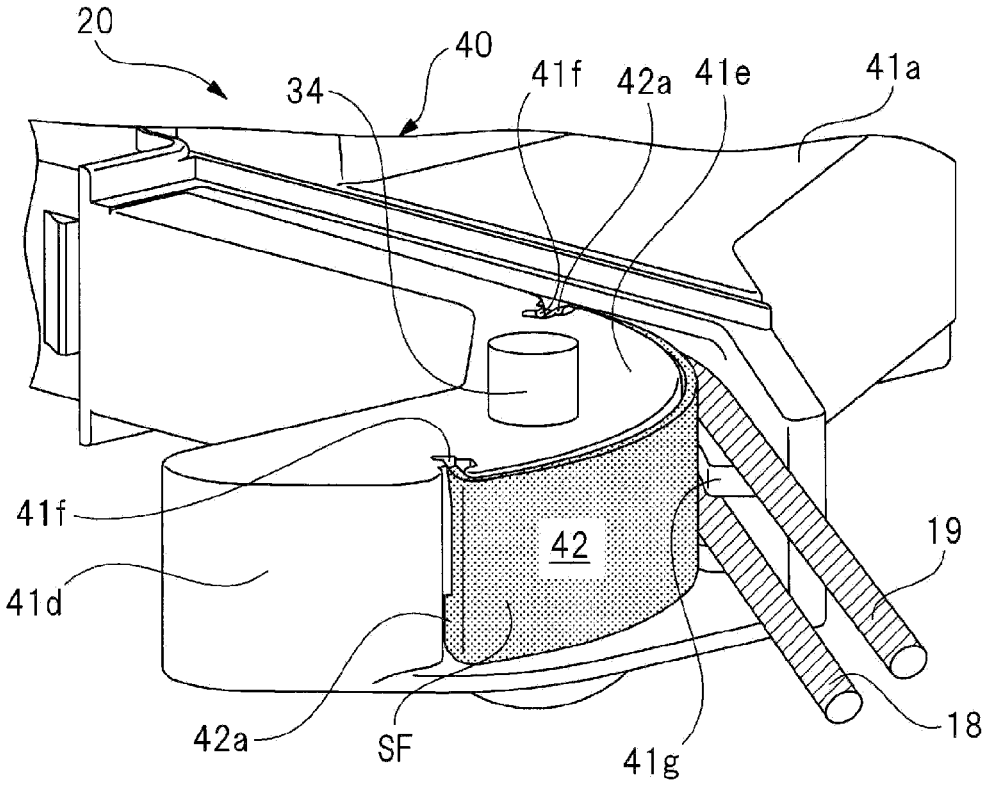
FIG. 5A and FIG. 5B are schematic perspective views illustrating structures of a guide plate and a cable separator.
Figure 5B:
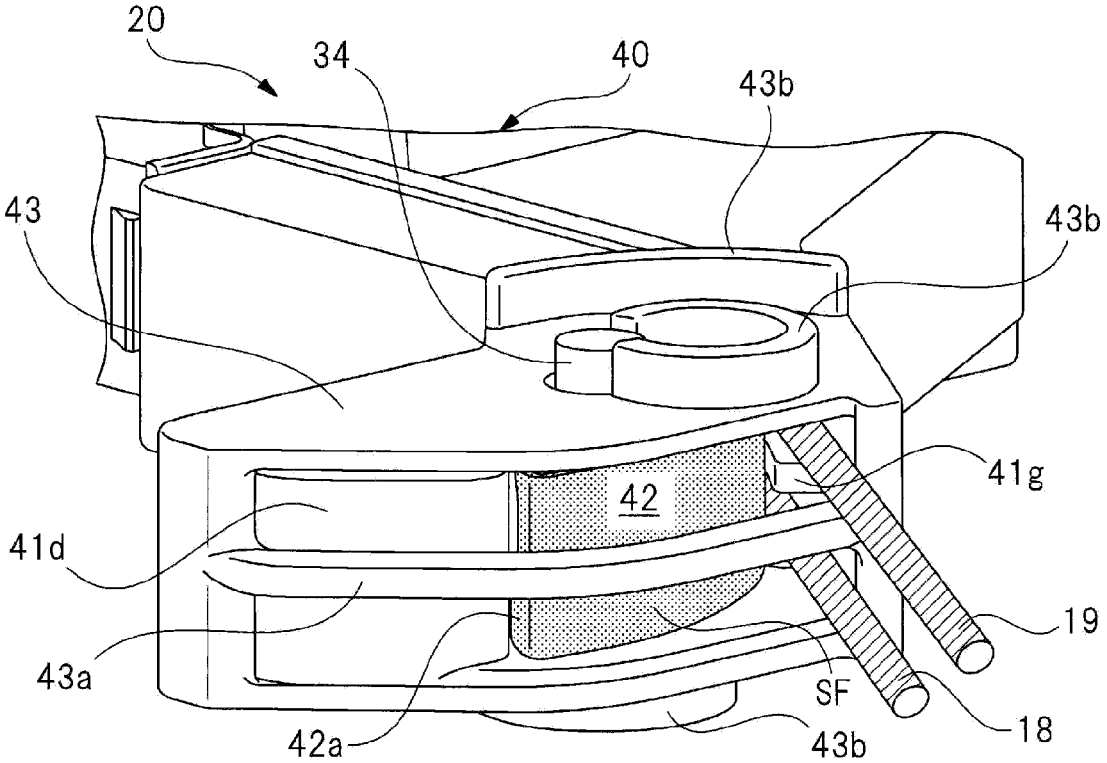
Figure 6:
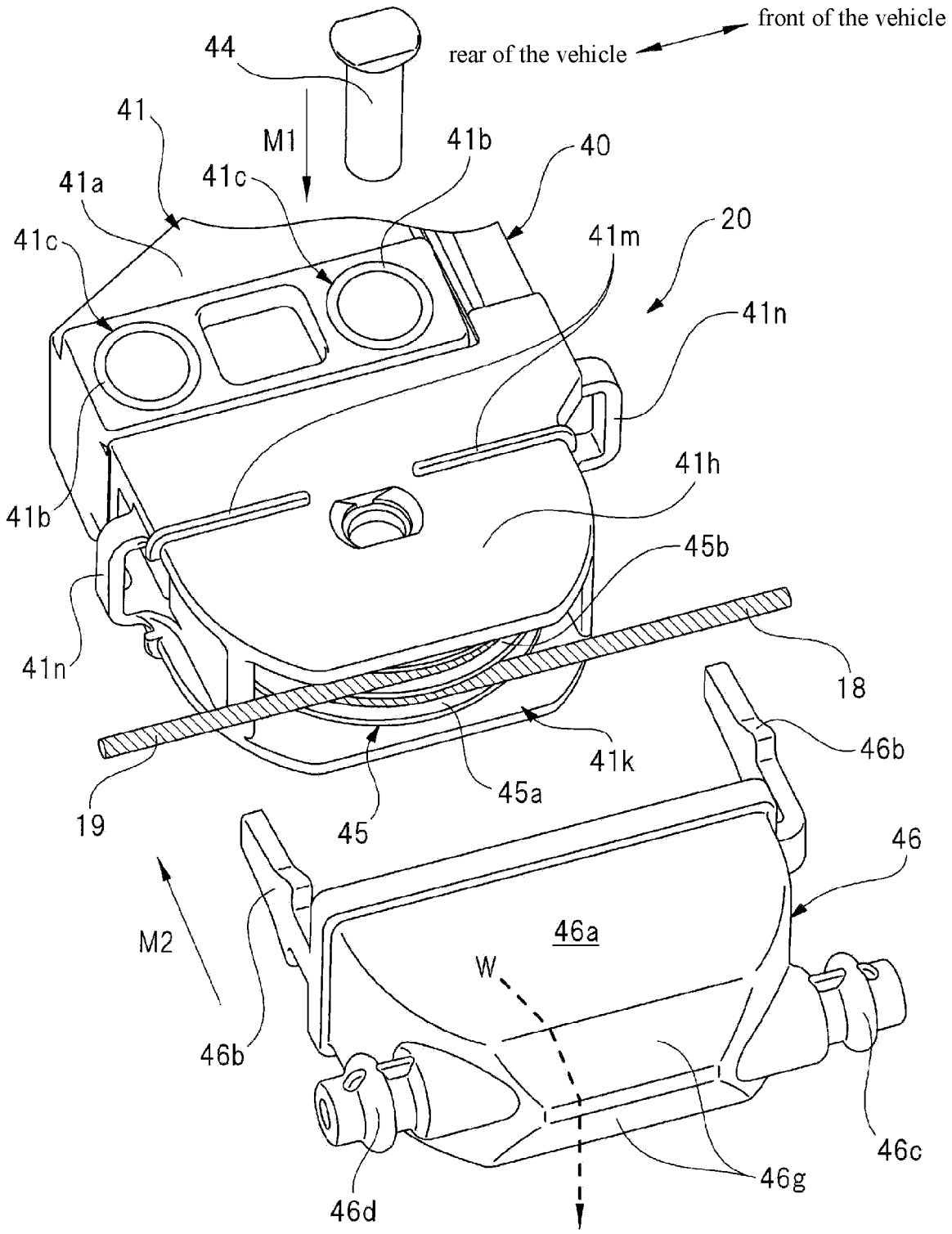
FIG. 6 is a schematic perspective view illustrating structures of a pulley case and a seal cover.
Figure 7:
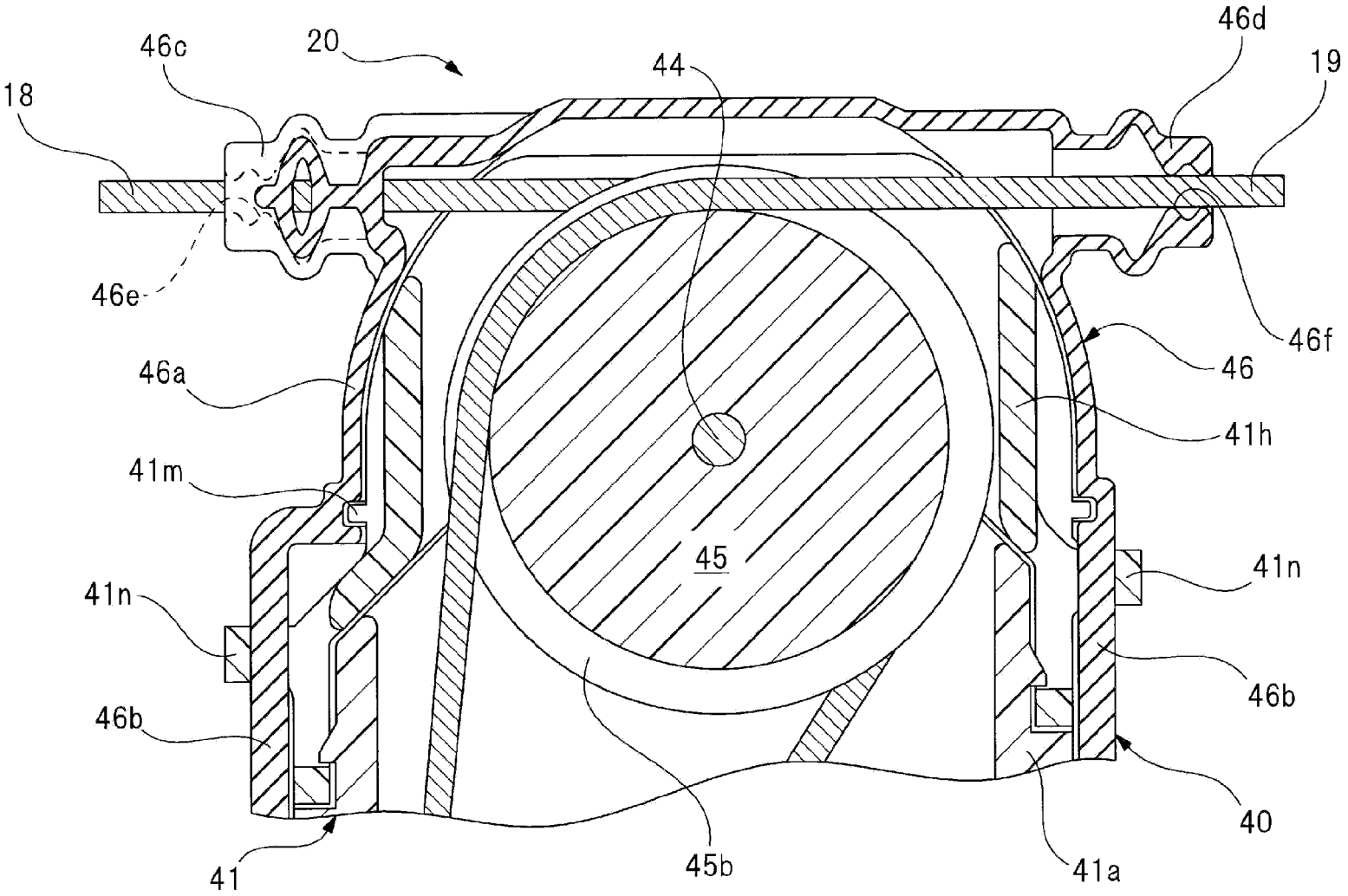
FIG. 7 is an explanatory diagram illustrating an internal structure of a pulley portion of the pulley case.
Figure 8:
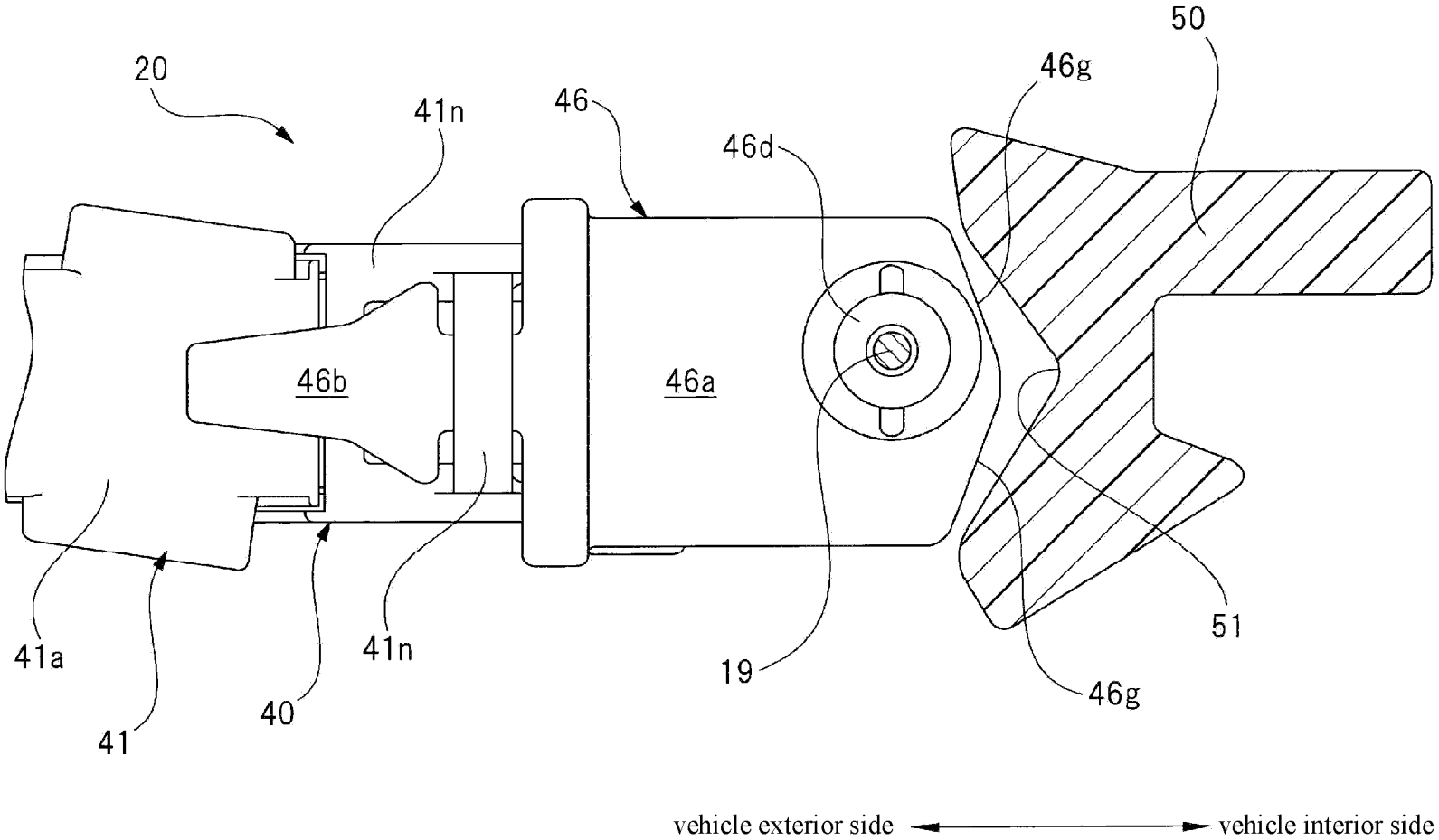
FIG. 8 is an explanatory diagram illustrating a positional relationship between the pulley part and a cable guide.

FIG. 1 is a schematic side view of a vehicle equipped with an opening/closing apparatus for vehicles according to an embodiment of the disclosure. FIG. 2 is a schematic side view illustrating details of a pulley part of FIG. 1. FIG. 3 is a schematic perspective view of the pulley part as viewed obliquely from above. FIG. 4 is an explanatory diagram illustrating an internal structure of the pulley part. FIG. 5A and FIG. 5B are schematic perspective views illustrating structures of a guide plate and a cable separator. FIG. 6 is a schematic perspective view illustrating structures of a pulley case and a seal cover. FIG. 7 is an explanatory diagram illustrating an internal structure of a pulley portion of the pulley case. FIG. 8 is an explanatory diagram illustrating a positional relationship between the pulley part and a cable guide.

A vehicle 10 shown in FIG. 1 is a wagon-type passenger car of lightweight vehicle standards. The vehicle 10 is provided with a vehicle body 11, and an opening 12 is formed on a side portion of the vehicle body 11 so that a passenger or the like can get on and off easily. The opening 12 may be exposed and closed by a sliding door (opening/closing body) 13 which is moved in a front-rear direction (i.e., a left-right direction in the drawing) of the vehicle 10.

The sliding door 13 is adapted to be moved by driving of an opening/closing apparatus 14 for vehicles. That is, the opening/closing apparatus 14 for vehicles is adapted to open and close the sliding door 13. The opening/closing apparatus 14 for vehicles has a roller part 15. The roller part 15 is disposed at an end portion of the sliding door 13 on a vehicle rear side (i.e., a right side in the drawing) in a substantially middle part in a vertical direction. On the other hand, a center rail (guide rail) 16 is fixed on the vehicle rear side with respect to the opening 12 of the vehicle body 11 in a substantially middle part in the vertical direction.

As shown in FIG. 2, the roller part 15 has a body bracket 15*a*. In the body bracket 15*a*, a plurality of rollers (not shown) are rotatably provided. Further, the body bracket 15*a* is supported swingably with respect to a support bracket (not shown) fixed to the sliding door 13. Specifically, the body bracket 15*a* is swingable in a horizontal direction with respect to the sliding door 13.

The center rail 16 is formed in a bar shape having a substantially U-shaped cross section by press forming a stainless steel plate or the like. An end of the center rail 16 on a vehicle front side (i.e., a left side in the drawing) is curved toward a vehicle interior side. As a result, each roller of the roller part 15 travels on the center rail 16, and the sliding door 13 is moved in the front-rear direction of the vehicle 10 along the side portion of the vehicle body 11, and the opening 12 is exposed and closed. At this time, the roller part 15 is guided to the vehicle front side of the center rail 16, and the vehicle rear side of the sliding door 13 is drawn to the vehicle interior side so that the sliding door 13 is flush with a side surface of the vehicle body 11.

An upper roller part and a lower roller part (both not shown) are provided on upper and lower portions of the sliding door 13 on the vehicle front side. Correspondingly, an upper rail and a lower rail (both not shown) are provided on the upper and lower portions of the opening 12 of the vehicle body 11. In this way, the sliding door 13 is supported to be movable in a stable state with respect to the vehicle body 11 by three rails and three roller parts.

As shown in FIG. 1, the opening/closing apparatus 14 for vehicles includes a driving device 17. The driving device 17 includes an electric motor 17*a* and a drum part 17*c*. The electric motor 17*a* is provided inside the sliding door 13 and is provided with a rotary shaft (not shown) rotated in forward and reverse directions. The drum part 17*c* houses a drum 17*b* that is rotated in forward and reverse directions by the electric motor 17*a*. Then, a base-end side of a closing-side cable (cable) 18 and a base-end side of an opening-side cable (cable) 19 are respectively wound on the drum 17*b*. In particular, the base-end sides of the cables 18 and 19 are wound around the drum 17*b*, such that when the closing-side cable 18 is wound up, the opening-side cable 19 is unwound, and when the opening-side cable 19 is wound up, the closing-side cable 18 is unwound.

As a result, by rotating the electric motor 17*a* in forward and reverse directions, the cables 18 and 19 are driven (moved) in opposite directions to each other. That is, each of the cables 18 and 19 is driven by the driving device 17, and when the closing-side cable 18 is wound up, the sliding door 13 is moved in a direction to close the opening 12. Conversely, when the opening-side cable 19 is wound up, the sliding door 13 is moved in a direction to expose the opening 12.

As shown in FIG. 1 to FIG. 4, the opening/closing apparatus 14 for vehicles includes a pulley part 20. The pulley part 20 is provided between the driving device 17 and the roller part 15. The pulley part 20 draws the closing-side cable 18 and the opening-side cable 19 drawn out from the drum 17*b* to the vicinity of the roller part 15. With the pulley part 20, a front-end side of the closing-side cable 18 is routed toward the front side of the vehicle body 11, and a front-end side of the opening-side cable 19 is routed toward the rear side of the vehicle body 11. That is, the pulley part 20 has a function of distributing the cables 18 and 19 to the front and rear of the vehicle body 11, respectively.

Here, the front-end side of the closing-side cable 18 is fixed to the vehicle front side of a cable guide 50 (see FIG. 1 and FIG. 2), and the front-end side of the opening-side cable 19 is fixed to the vehicle rear side of the cable guide 50.

As shown in FIG. 2 to FIG. 4, the pulley part 20 is composed of a first part member 30 fixed to the sliding door 13, and a second part member 40 fixed to the body bracket 15*a*.

The first part member 30 is provided with a body 31 made of a resin material such as plastic. Inside the body 31, as shown in FIG. 4, a hollow part 31*a* is formed. Inside the hollow part 31*a*, the closing-side cable 18 and the opening-side cable 19 are inserted without being in contact with each other.

In addition, the first part member 30 is provided with a cover member 32 made of a resin material such as plastic. The cover member 32 closes a body opening 31*b* of the body 31, which prevents rainwater, dust or the like from adhering to the cables 18 and 19 inserted into the first part member 30, i.e., the hollow part 31*a*.

In FIG. 4, to facilitate understanding of an internal structure of the first part member 30, only the body 31 is shown, and the cover member 32 attached to the body 31 is not shown. Furthermore, to facilitate understanding of an internal structure of the second part member 40, only a pulley case 41 is shown, and a cable separator 43 and a seal cover 46 attached to the pulley case 41 are not shown.

Between the body 31 and the cover member 32, a cap member 33 is mounted. In the cap member 33, a pair of cable holes 33*a* and 33*b* is formed at a predetermined interval. The cables 18 and 19 are inserted into the cable holes 33*a* and 33*b*, respectively, which prevents the cables 18 and 19 from contacting each other in the hollow part 31*a*.

Here, the closing-side cable 18 and the opening-side cable 19 are formed by twisting a plurality of thin metal wires, and an outer covering (not shown) made of resin is provided so as to cover outer circumferences of the cables. In the hollow part 31*a*, as described above, the cables 18 and 19 are prevented from coming into contact with each other. Therefore, in the hollow part 31*a*, the outer covering of each of the cables 18 and 19 is not scratched.

The cap member 33 is prevented from coming out with respect to both the body 31 and the cover member 32 by a stepped part DS (only the stepped part DS on the side of the body 31 is shown in FIG. 4).

A pair of fixing legs 31*c* and 32*a* to be fixed to the sliding door 13 are integrally provided on a portion (on the left side in FIG. 2 and FIG. 3) close to the cap member 33 along a longitudinal direction of the body 31 and the cover member 32. Metallic collar members 31*d* and 32*b* are attached to the pair of fixing legs 31*c* and 32*a*. Fixing bolts (not shown) are inserted through the collar members 31*d* and 32*b*. As a result, the first part member 30 is firmly fixed to the sliding door 13.

The cover member 32 is attached to the body 31 by a total of four fixing screws S (only one is shown in FIG. 2 and only two are shown in FIG. 3).

As shown in FIG. 4, on a side opposite to the side of the cap member 33 along the longitudinal direction of the body 31 and the cover member 32 (i.e., on an upper side in the drawing), a support shaft 34 for swingably supporting the pulley case 41 of the second part member 40 is provided. The support shaft 34 is provided to be sandwiched between the body 31 and the cover member 32. A swing arm 41*d* of the pulley case 41 is swingably supported by the support shaft 34.

Here, around the support shaft 34 in the body 31 and the cover member 32, a plurality of first sliding contact ribs 35 are provided for smoothing a swing motion of the swing arm 41*d*. In FIG. 4, only the first sliding contact ribs 35 on the side of the body 31 are shown. The cable separator 43 (see FIG. 5B) is attached to the swing arm 41*d*. As a result, the cable separator 43 slidably contacts each of the first sliding contact ribs 35 without slidably contacting the body 31 and the cover member 32 over the entire surface. Therefore, the swing arm 41*d* can swing smoothly.

Further, in a state where the cover member 32 is attached to the body 31, a part opening 30*a* is formed in the vicinity of the support shaft 34 of the first part member 30. The part opening 30*a* is largely opened in a direction intersecting the longitudinal direction of the first part member 30 so that the second part member 40 can swing greatly with respect to the first part member 30. Specifically, as shown by an arrow SW in FIG. 4, the second part member 40 is capable of swinging with respect to the first part member 30 within a predetermined angle range (for example, a range of 45 degrees).

In this way, by configuring the second part member 40 to be swingable around the support shaft 34 with respect to the first part member 30, when the sliding door 13 is retracted into the vehicle body 11, the second part member 40 is swung in accordance with the portion of the cable guide 50 (see FIG. 1 and FIG. 2) on the vehicle front side that is curved toward the vehicle interior side.

As shown in FIG. 2 to FIG. 4, the second part member 40 includes the pulley case 41 composed of a resin material (i.e., made of resin) such as plastic. The pulley case 41 has a case body 41*a* fixed to the body bracket 15*a*. The case body 41*a* is hollow, and the closing-side cable 18 and the opening-side cable 19 are inserted through the case body 41*a*.

The case body 41*a* is provided with a pair of bolt insertion holes 41*c*, each of which is provided with a metal collar 41*b* made of metal. As shown in FIG. 4, the bolt insertion holes 41*c* are arranged at positions to avoid the cables 18 and 19 passing through the inside of the case body 41*a*.

The swing arm 41*d* is provided on the side of the first part member 30 along the longitudinal direction of the pulley case 41. A base-end side of the swing arm 41*d* is connected to the case body 41*a*, and the swing arm 41*d* is formed to be narrower than the case body 41*a*. A front-end side of the swing arm 41*d* enters the hollow part 31*a* from the part opening 30*a* of the first part member 30 and is swingably supported by the support shaft 34. As a result, the pulley case 41 is swung as indicated by the arrow SW in the drawing.

As shown in FIG. 4, FIG. 5A and FIG. 5B, on the front-end side of the swing arm 41*d* and in the vicinity of the support shaft 34, a guide plate mounting part 41*e* is provided, which has a substantially arc-shaped cross-section in a direction intersecting an axial direction of the support shaft 34. A radius of curvature of the guide plate mounting part 41*e* is slightly larger than a radius of curvature on an inner side of a guide plate 42 (hatched portion in the drawing) in a radial direction of the guide plate 42, which reliably suppresses rattling of the guide plate 42 with respect to the guide plate mounting part 41*e*. In addition, engaging recesses 41*f* are provided on two sides of the guide plate mounting part 41*e* in a longitudinal direction of the guide plate mounting part 41*e* to respectively engage with a pair of engaging claws 42*a* provided on the guide plate 42.

The guide plate mounting part 41*e* is provided outside the support shaft 34 in the radial direction. As a result, when the second part member 40 is swung with respect to the first part member 30, the guide plate 42 attached to the guide plate mounting part 41*e* is swung radially outside of the support shaft 34. Therefore, without increasing a size of the guide plate 42, the cables 18 and 19 can be in sliding contact with a sliding contact curved surface SF of the guide plate 42 at all times.

Here, the guide plate 42 attached to the guide plate mounting part 41*e* constitutes a guide part in the disclosure and is, for example, formed into a substantially arc shape by press working a stainless steel plate (made of metal). The engaging claws 42*a* are respectively provided on two sides of the guide plate 42 in the longitudinal direction. The engaging claws 42*a* are formed by bending the guide plate 42 radially inward. During operation of the opening/closing apparatus 14 for vehicles (see FIG. 1), the cables 18 and 19 are in sliding contact with the arc-shaped sliding contact curved surface SF formed on the radially outer side of the guide plate 42.

Each of the cables 18 and 19 is in sliding contact with the sliding contact curved surface SF with a certain degree of sliding resistance. However, the outer coverings made of resin are provided on the outer circumferences of the cables 18 and 19. Therefore, the sliding resistance of the cables 18 and 19 with respect to the sliding contact curved surface SF does not become so large as to adversely affect movement of the sliding door 13.

However, to adjust the sliding resistance of the cables 18 and 19 against the sliding contact curved surface SF, for example, if the sliding resistance is to be reduced, a coating such as PTFE (tetrafluoroethylene resin) or the like may be formed on the sliding contact curved surface SF of the guide plate 42.

Also, the guide plate 42 is provided between the drum 17*b* of the driving device 17 and a pulley 45 housed in a pulley housing part 41*h*. That is, the guide plate 42 has a function of guiding the direction of the cables 18 and 19, which are pulled out from the drum 17*b* and inserted through the hollow part 31*a* of the first part member 30, toward the pulley 45.

As shown in FIG. 5A and FIG. 5B, in the vicinity of the guide plate mounting part 41*e* of the swing arm 41*d*, a protrusion part 41*g* is provided to prevent the closing-side cable 18 and the opening-side cable 19, which are in sliding contact with the guide plate 42, from contacting each other. Specifically, the protrusion part 41*g* is disposed at a portion facing the guide plate 42 along a direction intersecting the axial direction of the support shaft 34.

A protruding height of the protrusion part 41*g* is set such that a tip portion of the protrusion part 41*g* approaches the sliding contact curved surface SF of the guide plate 42 with almost no gap present therebetween. As a result, the cables 18 and 19 sliding against the guide plate 42 are separated from each other by the protrusion part 41*g* and are prevented from contacting each other.

Here, it is required to reliably prevent the contact between the cables 18 and 19 in advance particularly at the portion of the guide plate 42. In other words, the portion of the guide plate 42 against which the cables 18 and 19 are inserted is narrow. Moreover, during operation of the opening/closing apparatus 14 for vehicles, the cables 18 and 19 are moved in opposite directions against the portion of the guide plate 42, so that a relative speed between the cables 18 and 19 at that portion is high.

Therefore, if the cables 18 and 19 were not separated, the cables 18 and 19 would be easily brought into contact with each other, so that the outer coverings of the cables 18 and 19 might be damaged at an early stage. In order to more reliably prevent such damage, the protrusion part 41*g* is provided in this embodiment to separate the cables 18 and 19.

Further, as shown in FIG. 5B, the cable separator 43 is attached to the swing arm 41*d*. The cable separator 43 is formed of a resin material such as plastic in a predetermined shape. Similar to the protrusion part 41*g*, the cable separator 43 has a function of reliably separating the cables 18 and 19 to prevent contact between the cables 18 and 19.

Specifically, a bridging part 43*a* that divides an opening of the cable separator 43 into two parts is provided in the cable separator 43 on the side of the first part member 30. As a result, the cables 18 and 19 leaning against the guide plate 42 are separated, and the contact between the cables 18 and 19 is surely prevented.

Furthermore, on two sides of the cable separator 43 along the axial direction of the support shaft 34, a plurality of second sliding contact ribs 43*b* are provided. The second sliding contact ribs 43*b* have the same function of smoothing the swing motion of the swing arm 41*d* as the plurality of first sliding contact ribs 35 (see FIG. 4) provided in the body 31 and the cover member 32.

As shown in FIG. 4, the pulley housing part 41*h* is provided on the opposite side to the swing arm 41*d* along the longitudinal direction of the pulley case 41. Furthermore, as shown in FIG. 6, a pulley mounting opening 41*k* is formed in the pulley housing part 41*h* on the side opposite to the case body 41*a* (i.e., on the lower side in the drawing). The pulley 45 is mounted through the pulley mounting opening 41*k*. Here, the pulley mounting opening 41*k* constitutes an opening in the disclosure.

A pulley shaft 44 is attached to the pulley housing part 41*h* to pass through the pulley housing part 41*h* in a thickness direction of the pulley housing part 41*h*. The pulley shaft 44 is formed of a steel material in a substantially cylindrical shape, and the pulley 45 is rotatably attached to the pulley shaft 44. As a result, the pulley 45 is rotatably housed in the pulley housing part 41*h*.

Here, to assemble the pulley 45 to the pulley housing part 41*h*, first, the pulley 45 is inserted through the pulley mounting opening 41*k* into the pulley housing part 41*h*. Next, as shown by an arrow M1 in the drawing, the pulley shaft 44 is fixed to the pulley housing part 41*h*. As a result, the pulley 45 is rotatably supported by the pulley shaft 44.

The pulley 45 is formed of a resin material such as plastic by injection molding in a substantially disk shape. A first pulley groove 45*a* and a second pulley groove 45*b* are formed in an outer peripheral portion of the pulley 45. The pulley grooves 45*a* and 45*b* are arranged to be side by side in an axial direction of the pulley shaft 44 (or the pulley 45). The closing-side cable 18 is routed in the first pulley groove 45*a* and the opening-side cable 19 is routed in the second pulley groove 45*b*.

Here, the routing directions of the cables 18 and 19 with respect to the respective pulley grooves 45*a* and 45*b* are opposite to each other as shown in FIG. 6. Specifically, the closing-side cable 18 routed in the first pulley groove 45*a* is pulled out toward the vehicle front side (i.e., the right side in the drawing). On the other hand, the opening-side cable 19 routed in the second pulley groove 45*b* is pulled out toward the vehicle rear side (i.e., the left side in the drawing).

Further, as shown in FIG. 2, the pulley housing part 41*h* of the pulley case 41 is arranged near the center rail 16. That is, the pulley 45 housed in the pulley housing part 41*h* is also arranged near the center rail 16. The pulley 45 then directs the orientations of the closing-side cable 18 and the opening-side cable 19 in an extension direction of the center rail 16, that is, in the front-rear direction of the vehicle.

As shown in FIG. 6, on two sides outside of the pulley housing part 41*h* along the axial direction of the pulley shaft 44, sealing positioning protrusions 41*m* (only one side is shown in the drawing) are provided. The sealing positioning protrusions 41*m* extend linearly in a direction intersecting a longitudinal direction of the pulley case 41, and an edge portion of a seal body 46*a* of the seal cover 46 is mounted to the sealing positioning protrusions 41*m* (see FIG. 7), which positions the seal cover 46 in a proper position of the pulley housing part 41*h*.

A pair of hook parts 41*n* having a substantially U-shaped cross-section is integrally provided on the outside of the pulley housing part 41*h*. In particular, the pair of hook parts 41*n* is arranged opposite to each other on the outside of the pulley housing part 41*h* and radially outer to the pulley 45, which prevents an increase in the thickness dimension of the pulley housing part 41*h* along the axial direction of the pulley shaft 44. Hook pieces 46*b* of the seal cover 46 are hooked to the pair of hook parts 41*n*, respectively.

As shown in FIG. 6 and FIG. 7, the seal cover 46 is mounted to the pulley housing part 41*h*. The seal cover 46 is formed of an elastic material such as rubber in a predetermined shape and prevents rainwater or the like from entering inside the pulley housing part 41*h*.

Specifically, the seal cover 46 is provided with the seal body 46*a*. The seal body 46*a* closes the pulley mounting opening 41*k* of the pulley housing part 41*h* and covers a portion of the pulley shaft 44 in the pulley housing part 41*h*. Thereby, rainwater or the like is prevented from entering the inside of the pulley housing part 41*h* through the portion of the pulley mounting opening 41*k* and the portion of the pulley shaft 44 of the pulley housing part 41*h*.

The pair of hook pieces 46*b* is integrally provided on an opening side (i.e., the upper side in FIG. 6) of the seal body 46*a*. The hook pieces 46*b* are adapted to be hooked by the pair of hook parts 41*n* provided on the pulley housing part 41*h*.

Here, to mount the seal cover 46 to the pulley housing part 41*h*, first, the opening side of the seal cover 46 is oriented to face the pulley housing part 41*h*, and the pair of hook pieces 46*b* is inserted into the pair of hook parts 41*n* as indicated by an arrow M2 in FIG. 6. Next, the pair of hook pieces 46*b* is pulled and fit with the pair of hook parts 41*n*. Thereby, the edge portion of the seal body 46*a* is mounted on the sealing positioning protrusions 41*m* provided on the pulley housing part 41*h*, and the seal cover 46 is mounted at the proper position of the pulley housing part 41*h*.

Further, a first cable insertion part 46*c* and a second cable insertion part 46*d* are integrally provided on a side of the seal body 46*a* (i.e., the lower side in FIG. 6) opposite to the opening side of the seal body 46*a*. The cable insertion parts 46*c* and 46*d* are respectively oriented in the extension direction of the center rail 16, that is, in the front-rear direction of the vehicle. Moreover, as shown in FIG. 7, the closing-side cable 18 is inserted into a first seal part (seal part) 46*e* of the first cable insertion part 46*c*, and the opening-side cable 19 is inserted into a second seal part (seal part) 46*f* of the second cable insertion part 46*d*.

The first seal part 46*e* and the second seal part 46*f* allow sliding of the cables 18 and 19, respectively and provide seal between the inside and the outside of the pulley housing part 41*h*. In other words, rainwater or the like is prevented from entering the inside of the pulley housing part 41*h* through between the seal parts 46*e* and 46*f* and the cables 18 and 19.

Accordingly, by mounting the seal cover 46 to the pulley housing part 41*h*, the inside of the pulley housing part 41*h* is sealed from the outside. Therefore, dust or the like is prevented from entering between the pulley shaft 44 and the pulley 45. As a result, increase in the rotational resistance of the pulley 45 with respect to the pulley shaft 44 is reliably prevented.

Moreover, rainwater or the like adhered to the surfaces of the cables 18 and 19 can be scraped off at the entrances of the cable insertion parts 46*c* and 46*d* outside the seal cover 46. Therefore, each of the cables 18 and 19 always comes back inside the pulley housing part 41*h* in a clean state. As a result, scratches on the sliding contact curved surface SF (see FIG. 4, FIG. 5A and FIG. 5B) of the guide plate 42, with which the cables 18 and 19 are brought into sliding contact, are also reliably prevented.

As shown in FIG. 6 and FIG. 8, the seal body 46*a* of the seal cover 46 is provided with a pair of inclined surfaces 46*g*. Specifically, the pair of inclined surfaces 46*g* is provided in the seal body 46*a* on the side of the cable insertion parts 46*c* and 46*d* opposite to the side of the hook pieces 46*b*. As shown in FIG. 8, because of the pair of inclined surfaces 46*g*, the seal cover 46 is tapered toward the cable guide 50.

Here, the cable guide 50 is formed of a resin material such as plastic to have a shape similar to the shape of the center rail 16. The cable guide 50 is arranged right under the center rail 16 (see FIG. 1 and FIG. 2). That is, the cable guide 50 is provided parallel to the center rail 16.

Also, as shown in FIG. 2 and FIG. 8, the cable guide 50 is provided with a cable holding groove 51 for holding the closing-side cable 18 and the opening-side cable 19. The cable holding groove 51 is recessed toward the vehicle interior side, so that an operator is prevented from touching the cables 18 and 19 exposed to the outside during car washing or other similar operations.

As shown in FIG. 8, the seal cover 46 on the side of the cable guide 50 is tapered because of the pair of inclined surfaces 46*g* and faces the cable holding groove 51. Further, a portion of the pair of inclined surfaces 46*g* enters the cable holding groove 51. Accordingly, the pair of inclined surfaces 46*g* that forms the tapered shape on the seal cover 46 is provided in a portion of the seal cover 46 that faces the cable guide 50, so that the pulley part 20 including the seal cover 46 can be arranged closer to the cable guide 50.

Further, the pair of inclined surfaces 46*g* has the following function in addition to the function of enabling the pulley part 20 to be arranged close to the cable guide 50. That is, as shown by a broken line arrow in FIG. 6, the pair of inclined surfaces 46*g* has the function of rapidly dripping rainwater W that falls on the seal body 46*a* of the seal cover 46 to below the pulley part 20. Thereby, the seal cover 46 is prevented from becoming dirty or deteriorating at an early stage.

As detailed above, in the opening/closing apparatus 14 for vehicles according to the embodiment, the guide plate 42 is provided between the drum 17*b* and the pulley 45 to direct the orientation of the closing-side cable 18 and the opening-side cable 19 drawn out from the drum 17*b* to the pulley 45. The guide plate 42 has the sliding contact curved surface SF with which the cables 18 and 19 are brought into sliding contact. Moreover, the guide plate 42 is provided on the swing arm 41*d* of the pulley case 41 in which the pulley 45 is rotatably housed.

Thus, it is possible to replace the previously required three pulleys with "one" pulley 45 which directs the orientation of the cables 18 and 19 in the extension direction of the center rail 16. Therefore, the number of components can be reduced to reduce the size and weight.

Also, since each of the cables 18 and 19 is brought into sliding contact with the sliding contact curved surface SF of the guide plate 42, it is possible to increase the sliding resistance of the cables 18 and 19 as compared with the related art. Therefore, with the increase in the sliding resistance, it is possible to effectively suppress the rattling of the compact and lightweight sliding door 13 provided in the vehicle 10 of the lightweight vehicle standards.

Furthermore, in the opening/closing apparatus 14 for vehicles according to the embodiment, since the pulley case 41 is made of resin and the guide plate 42 is made of metal, the weight of the pulley part 20 can be reduced, and the strength of the portion where the cables 18 and 19 are rubbed (i.e., the portion of the guide plate 42) can be increased.

In the opening/closing apparatus 14 for vehicles according to the embodiment, the seal cover 46 for closing the pulley mounting opening 41*k* of the pulley case 41 is provided. The seal cover 46 includes the first seal part 46*e* and the second seal part 46*f*, which allow sliding of the cables 18 and 19 and provide seal between the inside and the outside of the pulley case 41.

Thereby, it is possible to seal the inside of the pulley housing part 41*h* from the outside, and dust or the like can be prevented from entering between the pulley shaft 44 and the pulley 45. Therefore, it is possible to reliably prevent the increase in the rotational resistance of the pulley 45 with respect to the pulley shaft 44.

Furthermore, in the opening/closing apparatus 14 for vehicles according to the embodiment, the cable guide 50 is provided parallel to the center rail 16 and holds the cables 18 and 19. The pair of inclined surfaces 46*g* that is tapered toward the cable guide 50 is provided in the portion of the seal cover 46 facing the cable guide 50.

As a result, the pulley part 20 including the seal cover 46 can be arranged closer to the cable guide 50. Therefore, the opening/closing apparatus 14 for vehicles can be reduced in size and weight. In addition, the rainwater W falling on the seal body 46*a* of the seal cover 46 can be rapidly dripped to below the pulley part 20. It is thus possible to effectively prevent the seal cover 46 from becoming dirty or deteriorating at an early stage.

The disclosure is not limited to the above embodiment, and various modifications can be made without departing from the gist thereof. For example, in the above embodiment, the guide part of the disclosure is provided with the guide plate 42 made of metal. However, the disclosure is not limited thereto. Depending on the strength requirement for the guide part, the guide plate 42 may be omitted. That is, the cables 18 and 19 may be brought into direct sliding contact with the surface of the guide plate mounting part 41*e* (see FIG. 4, FIG. 5A and FIG. 5B).

Further, the above embodiment illustrates a structure in which the front-end sides of the cables 18 and 19 are respectively fixed to two sides of the cable guide 50, which is provided right under the center rail 16, in the longitudinal direction of the cable guide 50, that is, a "center driving type". However, the disclosure is not limited thereto. For example, the disclosure is also applicable to a structure in which the cable guide 50 is provided in the vicinity of a lower rail, and the front-end sides of the cables 18 and 19 are respectively fixed to two sides of the cable guide 50 in the longitudinal direction, that is, a "lower driving type" opening/closing apparatus for vehicles.

In addition, the materials, shapes, sizes, numbers, installation locations, etc. of the constituent elements in the above embodiments are not limited to those described in the above embodiments and are adjustable as long as they can achieve the embodiments of the disclosure.

What is claimed is:

1. An opening and closing apparatus for vehicles for opening and closing an opening and closing body, the opening and closing apparatus comprising:

a guide rail movably supporting the opening and closing body;

a driving device provided in the opening and closing body;

a drum provided in the driving device, wherein cables for moving the opening and closing body are wound around the drum;

a pulley part, which comprises:

a pulley provided in a vicinity of the guide rail and directing orientation of the cables in an extension direction of the guide rail;

a first part member fixed to the opening and closing body;

a second part member comprising a pulley case in which the pulley is rotatably housed;

a support shaft around which the second part member is swingable with respect to the first part member;

a guide part provided between the drum and the pulley and directing the orientation of the cables drawn out from the drum to the pulley;

a seal cover for closing an opening of the pulley case, wherein the seal cover comprises a seal part that allows sliding of the cables and provides seal between inside and outside of the pulley case; and a cable guide for holding the cables, wherein the cable guide is parallel to the guide rail, and wherein a pair of inclined surfaces that is tapered toward the cable guide is provided in a portion of the seal cover that faces the cable guide, wherein the guide part has a sliding contact curved surface with which the cables are brought into sliding contact, and the guide part is provided in the pulley case.

2. The opening and closing apparatus for vehicles according to claim 1, wherein the pulley case is made of resin, and the guide part is made of metal.

* * * * *